United States Patent [19]

Shelton

[11] 4,243,062

[45] Jan. 6, 1981

[54] THERMOSTATIC SELF-POWERED DRAIN VALVE

[75] Inventor: Russell S. Shelton, Mt. Olive Township, Morris County, N.J.

[73] Assignee: Sheltech, Inc., Springfield, N.J.

[21] Appl. No.: 924,848

[22] Filed: Jul. 14, 1978

[51] Int. Cl.[3] ..... E03B 7/10; F16K 31/38

[52] U.S. Cl. ..... 137/62; 137/491; 137/625.6; 137/625.68; 237/80

[58] Field of Search ..... 123/41.14; 251/43; 237/80; 138/32; 137/79, 80, 301, 302, 59–62, 491, 625.6, 625.67, 625.68, 625.48

[56] References Cited

U.S. PATENT DOCUMENTS

| | | | |
|---|---|---|---|
| 629,794 | 8/1899 | Lindsay | 137/61 |
| 954,532 | 4/1910 | Mallory | 137/79 X |
| 2,301,318 | 11/1942 | Peo | 137/79 X |
| 3,227,179 | 1/1966 | Rosaen | 137/625.61 |
| 3,610,284 | 10/1971 | Spencer | 137/625.66 |

*Primary Examiner*—Martin P. Schwadron
*Assistant Examiner*—Richard Gerard
*Attorney, Agent, or Firm*—Roy M. Porter, Jr.

[57] ABSTRACT

A water or other fluid containing system is protected by a thermostatically controlled drain valve having input, output, drain and control ports. A slideable barrier within the valve selectively directs the flow within the valve between the ports. A small coupling orifice through the barrier allows equal static pressures to develop on opposite sides of the barrier, and a thermosensitive relief mechanism at the control port relieves the pressure on one side of the barrier when ambient temperature drops below a predetermined level. Unequal pressures upon the barrier shift the barrier, redirecting the flow within the valve.

9 Claims, 4 Drawing Figures

THERMOSTATIC SELF-POWERED DRAIN VALVE

BACKGROUND OF THE INVENTION

The prior art has recognized the need for thermostatically controlled hydraulic drain valves, particularly, for draining water systems in buildings and equipment to prevent breakage due to freezing. Typically, these drain valves are powered by a springtrip mechanism or by an expandable bellows mechanism, either of which senses a change in temperature and moves a suitably arranged valve piston from a first position which connects the system to the supply, to a second position which connects the system to a drain. Another type of valve considered by the prior art requires a thermostat and a source of external electrical power.

SUMMARY OF THE INVENTION

In accordance with the present invention, unique advantage is taken of differential pressure to provide a thermostatically controlled valve that is powered by the hydraulic pressure itself and requires no external power or complicated or unreliable spring-trip or bellows mechanisms. More particularly, a valve body having an input, output and drain port is provided with a slideable barrier retained within the valve body and suitably adapted to couple the input and output ports and to close the drain port in one position, but to couple the output port to the drain port and close the input in another position. A feature of the invention resides in a small coupling orifice which by-passes the barrier and allows equal hydraulic pressures to develop on opposite sides of the barrier under static conditions. This orifice acts in combination with thermally sensitive means for relieving the pressure on one side to move the barrier in the direction of the relieved pressure thereby reversing the coupling between the ports.

A further feature of the invention resides in the thermally sensitive relief mechanism comprising a capsule including a bimetal disc which snaps into reverse curvature at a predetermined temperature.

Another feature of the invention deals with the unique problems associated with protecting a system which has both high and low pressure components, such as, the high pressure potable water system and the low pressure boiler-heating system. Protection for such a system is achieved by providing a slave relief valve for the low pressure system.

DETAILED DESCRIPTION OF THE PREFERRED EMBODIMENT

Figure 1:
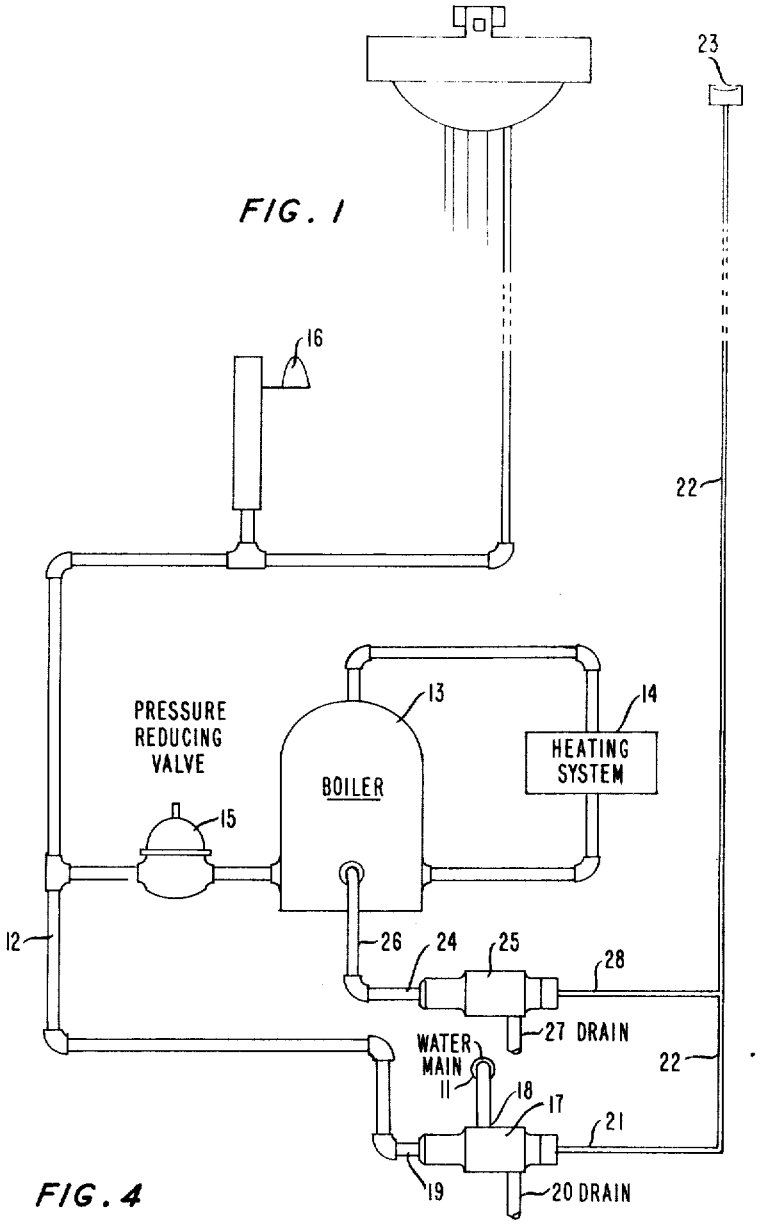
FIG. 1 is a schematic diagram of a water system having both high and low pressure sections, and shows master and slave temperature sensitive valves, respectively, associated with each section.

Referring more particularly to FIG. 1, a protected water system in accordance with the present invention is shown including a connection 11 to the water main, a connection 12 leading to the water using fixtures to be protected at the pressure of the main, a boiler 13 and a heating system 14 operating at a reduced pressure as provided by reducing valve 15. The conventional water system is completed by an air relief valve 16 of standard construction located at a suitably high point in the system which allows air in the system to escape as it is replaced by water and allows air to enter the system to replace water being drained out. Similar air relief valves will be found as an integral part of the conventional heating system.

Figure 2:
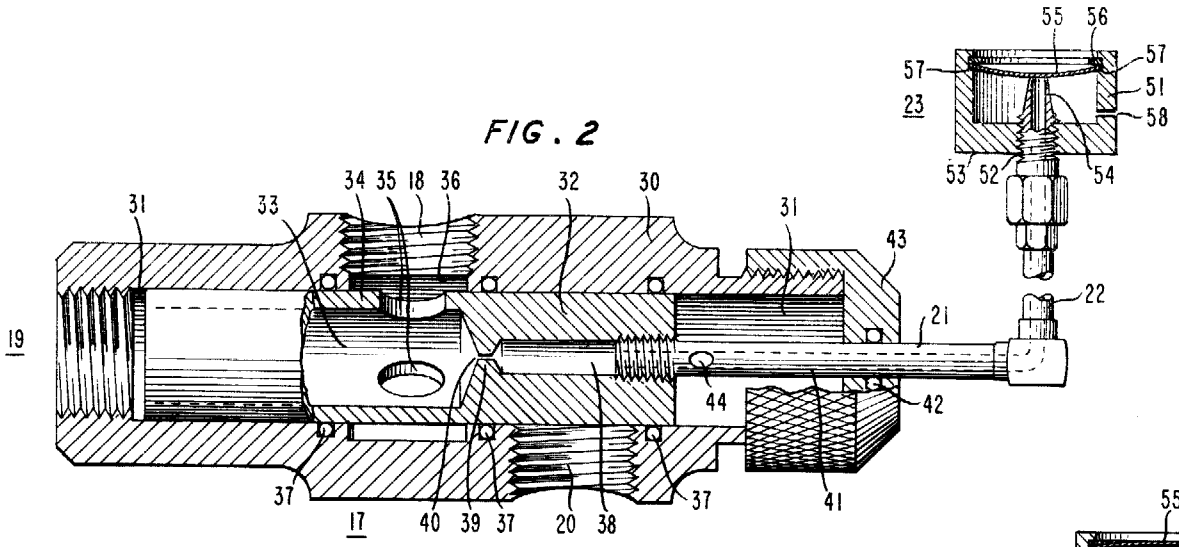
FIG. 2 is a cutaway cross-sectional view of the master valve of FIG. 1 in its normal position.
Figure 3:
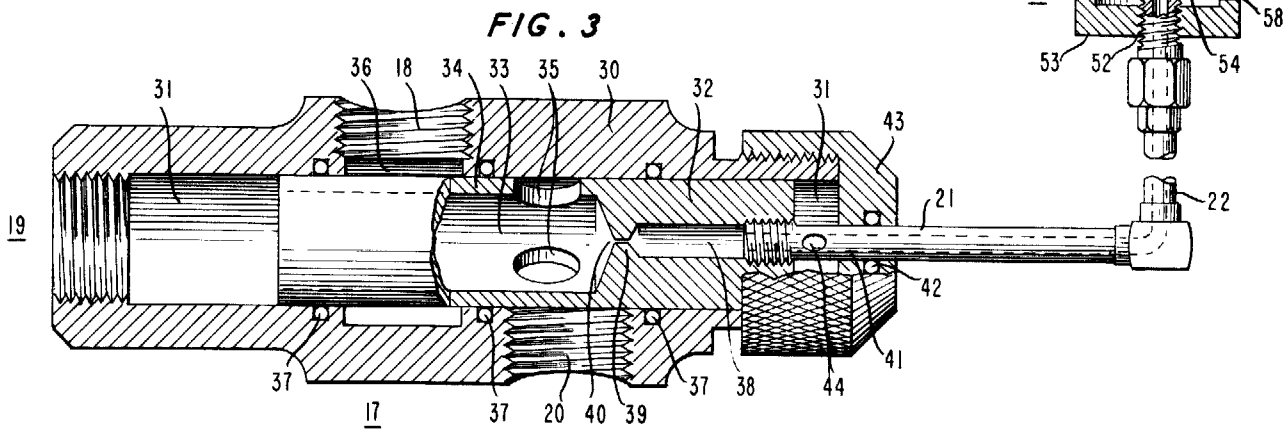
FIG. 3 is a cutaway cross-sectional view of the valve of FIG. 2 in its drain position.

Interposed between main 11, as close thereto as practical, and the water system to be protected is a thermostatically controlled valve 17 in accordance with the invention. Details of valve 17 are shown in FIGS. 2 and 3 and will be described in detail hereinafter. For the moment, it should be noted that valve 17 includes a port 18 connected to water main 11, a port 19 connected to the plumbing system to be protected, and a drain port 20 which preferably, but not necessarily, is connected to the sewer. A control port 21 from valve 17 is connected by a small tube 22 of metal or plastic to the remotely located temperature sensitive capsule 23, the details of which will also appear in connection with FIGS. 2 and 3. The purpose of the capsule 23 is to detect an abnormal drop in temperature, interpret this drop as meaning that there has been a heating failure, and start the sequence to be described in order to drain the system pipes before the temperature drops through the freezing level. Thus, it may be necessary to place capsule 23 via tube 22 in an area remote from valve 17 where the ambient temperature will reflect the desired conditions. Depending upon the structure to be protected, this location could be near the boiler, in a historically cold room or any other place in the structure.

The system of FIG. 1 is completed by inclusion of slave valve 25 to protect boiler 13. Thus, port 24 of slave valve 25 is connected to drain 26 of boiler 13. Valve 25 further includes a drain port 27 and a control port 28 which joins tube 22.

Referring now to FIG. 2, the details of the drain valve 17 are shown with input, output and control ports respectively corresponding to those in FIG. 1 designated by corresponding reference numerals. Valve 17 comprises a valve body 30 of brass, aluminum, or other material having a uniform axial bore forming a cavity 31 one end of which is common to port 19 and the other end is fitted with end cap 43. Ports 18 and 20 comprise transversely extending bores in body 30 intersecting cavity 31 at spaced longitudinal locations. Slideably received within cavity 31 is a cylindrical barrier body 32. While a number of alternative configurations for body 32 will occur to one skilled in the art, the preferred form illustrated in FIG. 2 is characterized by a bore or cavity 33 extending from the end adjacent port 19 to approximately the center of body 32 of diameter sufficiently less than the outside diameter of body 32 to leave a hollow cylinder 34. Three equally spaced openings 35 (only two of which appear in the cross section) connect cavity 33 to an annular recess 36 machined into body 30 at the location of port 18. When barrier body 32 is in the position shown, substantially unimpaired hydraulic flow takes place from port 19 through cavity 33 into openings 35, annular recess 36 to port 18. The solid portion of body 32 closes port 20. Longitudinally spaced "O" rings 37, received in small annular recesses in body 30, seal valve barrier body 32 but allow longitudinal movement of body 32 within cavity 31.

Body 32 includes a second axial bore 38, opposing and aligned with cavity 33, and having a longitudinal dimension sufficient to leave a thin barrier or partition 39 between the ends of bore 38 and cavity 33. An orifice 40 in partition 39, of small diameter as will be defined, connects cavity 32 and bore 38 through partition 39. While bore 38 is shown of smaller diameter than cavity 33, this is not essential to the broad principle of the invention but has unique design advantages now to be described.

Control port 21 is formed by tubular member 41 which extends through an opening in end cap 43, sealed by "O" ring 42, to be received and rigidly secured within bore 38. Tubular member 41 is free to move in concert with longitudinal movement of body 32 and the free end of tube 41 is connected by flexible tube 22 to the remote thermostatic capsule 23. An orifice 44 through the wall of tubular member 41 couples bore 38 to cavity 31. Thus hydraulic pressure in cavity 33 is coupled through orifice 40 to bore 38, thence through orifice 44 into cavity 31. Thus substantially equal hydraulic forces are presented to opposing transverse faces of barrier body 32.

Consider now the detail of thermostatic capsule 23 which includes a cup shaped body 51 having a thread tapped hole 52 in the center of its bottom wall 53 and a bleed hole 58 at some other suitable location. A nozzle-like member 54, threaded on its outside diameter is screwed into hole 52. The top of cup 51 is closed by a bi-metal disc 55 which is urged against shoulder 57 in the inner wall of cup 51 by springwasher 56.

Disc 55 is of construction, readily available on the market, having the property that at one temperature extreme, the surface of the disc 55 is cupped spherically in one direction and at the opposite temperature extreme the surface curvature is the reverse. The temperature at which the curvature snaps from one configuration to the other is a property of its bi-metal construction, but can be altered within reasonable limits by a mechanical bias force applied to the disc.

In accordance with the invention this property is utilized by mounting disc 55 so that its high temperature configuration is concaved downward as shown in FIG. 2. By screwing nozzle 54 into contact with the transverse surface of disc 55, disc 55 both closes the orifice of nozzle 54 and the mechanical pressure of nozzle 54 on disc 55 can be adjusted to cause disc 55 to snap into a concave upward configuration, as shown in FIG. 3, at a temperature slightly above freezing in the system to be protected.

While other forms may be used to practice the broad principles of the invention instead of the particular form illustrated for capsule 23, it should be noted that the form illustrated has particular advantages. For example, the snap action of disc 55 instantly opens the relief path to its full extent substantially while other forms creep into an open position. The temperature adjustment is easily variable and may be reset or adjusted at will. Capsule 22 is readily adaptable for remote location and its operation may be readily tested simply by dropping it into small container which includes floating ice cubes. The liquid in such a container is typically in the range of a few degrees centigrade and approximates the appropriate protective temperature for water systems.

Referring now to FIG. 3, the action of the valve in accordance with the invention may be understood after an important parameter of the present invention has been defined. Thus, it is specified that the effective coupling through orifice 40 as it couples between cavity 33 and bore 38, is smaller than the combined effective coupling through orifice 44, tube 41, tube 22, nozzle 54, and port 58 as they together enable hydraulic flow from cavity 31 to the atmosphere. Thus it is preferred that orifice 40 be as small as is consistent with the need to keep orifice 40 from being clogged by contaminates in the system.

Assume that the ambient temperature to which capsule 23 is exposed has dropped to the temperature at which disc 55 will snap into its concave upward configuration as shown in FIG. 3, this temperature being determined by the adjusted bias force of nozzle 54 upon disc 55 as described above. Thus the flow from cavity 31 to the atmosphere is faster than the flow into cavity 31 from cavity 35 through orifice 40. This immediately creates a smaller hydraulic force on the cavity 31 side of body 32 than on the side facity cavity 33, causing barrier body 32 to slide longitudinally toward the position shown in FIG. 3. The solid portion of cylinder 34 closes input port 18 shutting the supply from the main. Back pressure from the system by way of port 19 continues on barrier body 32 until its shift is completed, opening holes 35 to drain port 20. The arrangement of three holes 35 assures that some parts of two holes are aligned over port 20 regardless of the rotational position of body 32 about its axis. Port 19 is now connected to drain port 20 and will remain so until the valve is manually reset by using tubular rod 41 as a handle to push body 32 back into the position shown in FIG. 2.

The system must be purged of air through port 58 before adjusting the temperature setting of disc 55 by adjusting the force applied against it by nozzle 54.

While the dual use of rod 41 as a handle for body 32 and as part of the control port path is a feature of this invention, it should be noted that modifications by this portion are possible within the broad scope of the invention. For example, rod 41 may be eliminated by coupling tube 22 directly into threads which would replace "O" ring 42 in end cap 43. Fluid coupling during the relief mode of operation would be directly from bore 38 into cavity 31 and then into tube 22. Reset of body 32 is achieved by removing end cap 43 and pushing body 32 into its normal position with any suitable tool. Such a design is more suitable for locations in which there might be a danger of bending tube 41.

Consideration may now be given to the particular problem which arises when the system to be protected includes low pressure components. Referring again to FIG. 1 consider the following alternatives. If boiler 13 is protected by an auxiliary or second thermostatically sensitive valve in accordance with FIGS. 2 and 3, the probability that the auxiliary valve will release at precisely the same temperature as main valve 17 is small. If main valve 17 releases first, inadequate pressure is available to actuate the auxiliary valve. If the auxiliary valve releases first there is the possibility that the supply water might not be cut off for some period, causing a continuous flow through and out of boiler 13. On the other hand, if the main and auxiliary valves are connected in parallel to a single thermostatic capsule, high pressure from the main will feed back into the low pressure system through the pressure equalizing orifices in both valves, eventually raising the low pressure system to main pressure. None of these alternatives is desirable.

Figure 4:
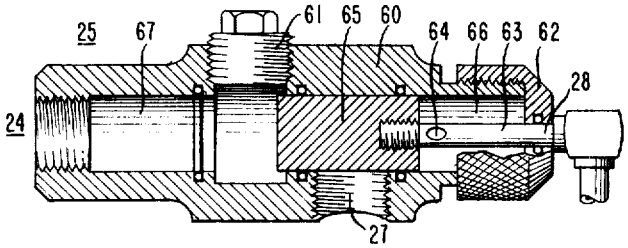
FIG. 4 is a cutaway cross-sectional view of the slave valve of FIG. 1 in its normal position.

In accordance with the present invention all of these undesirable consequences are eliminated by the uniquely designed slave valve 25 as shown in FIG. 4 in which the ports are numbered in accordance with FIG. 1. To simplify manufacturing inventory valve body 60 may be identical to body 30 of FIG. 2 but since the input port is not required, it is closed by plug 61. Similarly, end cap 62, tubular member 63 and orifice 64 are identical to corresponding components in FIG. 2. Modification of slave valve primarily resides in barrier body 65 which now comprises a solid cylindrical plug slidably received within valve body 60 so that it closes drain port 27 in one position and couples boiler port 24 to drain port 27 in the other position. Thus when control port 28 is connected in parallel with the main drain valve to thermostatic relief capsule 23, a drop in pressure in chamber 66 will cause barrier body 65 to shift under the influence of the remaining system pressure in chamber 65 thereby draining the low pressure system.

It should be apparent that a plurality of thermostatic capsules in accordance with the invention may be used with one drain valve to sense critical temperatures at a number of locations simultaneously. Similarly a plurality of drain valves can be activated by one or more capsules to drain a system at a number of positions simultaneously.

In all cases it is understood that the above described arrangements are merely illustrative of one embodiment of the invention and that numerous modifications thereof will readily occur to one skilled in the art.

We claim:

1. A hydraulic valve comprising a body having a longitudinal cavity therein and four ports opening into said cavity, means slideably retained within said cavity for coupling a first path between the first and second of said ports and for closing a second path between said first and a third of said ports when said slideable means is in a first longitudinal position, said slideable means forming a third path between said first port and a fourth port, said slideable means being moveable to a second longitudinal position within said cavity for closing said first path and opening said second path, and means utilizing hydraulic pressure applied to said first port for moving said slideable means to said second position, said means for moving comprising means connected to said fourth port for relieving hydraulic pressure in said third path on one side of said slideable means, a portion of said third path being substantially restricted by comparison to both said means for relieving and said first path whereby unequal hydraulic pressures are exerted upon opposite sides of said slideable means to produce movement into said second position in the direction of said relieved pressure.

2. The hydraulic valve of claim 1 wherein said means for relieving is temperature dependent.

3. The hydraulic valve of claim 2 wherein said means for relieving comprises a bi-metal disc extending transversely across said fourth port.

4. The hydraulic valve of claim 3 including a nozzle coupled to said third path, means for retaining said bi-metal disc in transverse contact with said nozzle to close said third path, and means for adjusting the static force exerted by said nozzle upon said disc whereby said disc opens said third path at a temperature dependent upon said force.

5. A fluid containing system protected against extreme temperatures comprising a body having a longitudinal cavity therein and three ports opening into said cavity, said protected system being connected to one of said ports, a source of fluid flow under pressure connected to a second of said ports, a drain for said fluids connected to a third of said ports, said body having a fourth port opening into said cavity, a transverse barrier slideably retained within said cavity and adapted for selectively coupling said one port to either said second port or said third port on one side of said barrier, said barrier including an orifice for coupling said one port on one side of said barrier to the other side thereof and to said fourth port, means utilizing hydraulic pressure present at said one port for reversing the coupling between said one port and said second and third ports, said means for reversing including thermally sensitive means for relieving hydraulic pressure at said fourth port to create unequal hydraulic pressures on opposite sides of said barrier whereby said barrier is moved longitudinally in the direction of said relieved pressure.

6. The system according to claim 5 wherein the sides of said barrier upon which said unequal hydraulic pressures are applied have transverse areas at least as large as the transverse area of said cavity less the area of said orifice.

7. The system according to claim 6 wherein said orifice is located axially with respect to both said barrier and said cavity.

8. The system according to claim 5 wherein the hydraulic flow through said means for relieving is substantially greater than the hydraulic flow through said orifice.

9. A fluid containing system protected against extreme temperatures comprising a portion connected to a source of fluid flow under pressure, and a portion operating at a low pressure substantially less than the pressure of said source, a drain for said fluids, a barrier means selectively interconnecting said system and said source and said drain for coupling under static conditions said source to said system and for isolating said drain, means for bypassing said barrier means with an initial small flow of said fluid at the pressure of said source to equalize static fluid pressure on opposite sides of said barrier means, means responsive to extreme temperature for relieving said pressure on one side of said barrier means at a rate that is large compared to said small flow resulting in a pressure differential across said barrier means, said barrier means being moveable in response to said pressure differential whereby said barrier means shifts into coupling relationship between said system and said drain and isolates said source, and a second barrier means for isolating said drain from said low pressure portion, said second barrier means being exposed to said low pressure on one side thereof, and means for applying the pressure from said one side of said first named barrier means to the other side of said second barrier means to react against said low pressure applied to said one side of said second barrier means whereby said second barrier means isolates said drain from said low pressure portion, and said second barrier means being responsive to pressure as relieved by said means responsive to temperature for coupling said low pressure portion to said drain.

* * * * *